United States Patent [19]

John, deceased et al.

[11] Patent Number: 4,499,638

[45] Date of Patent: Feb. 19, 1985

[54] DEVICE FOR INDIVIDUALLY SEPARATING AND ALIGNING HEDDLES FOR THREADING

[75] Inventors: Heinz John, deceased, late of Berneck, Switzerland; by Friedlinde John née Rüffler, heir, Gams, Switzerland

[73] Assignee: Lindauer Dornier Gesellschaft mbH, Lindau, Fed. Rep. of Germany

[21] Appl. No.: 430,288

[22] Filed: Sep. 30, 1982

[30] Foreign Application Priority Data

Nov. 3, 1981 [DE] Fed. Rep. of Germany ..... 3143484

[51] Int. Cl.[3] ..... D03J 1/14

[52] U.S. Cl. ..... 28/207

[58] Field of Search ..... 28/205, 206, 207

[56] References Cited

U.S. PATENT DOCUMENTS 2,828,527 4/1958 Meierhofer ..... 28/206

4,047,270 9/1977 Heinz ..... 28/205

FOREIGN PATENT DOCUMENTS 2109426 6/1983 United Kingdom ..... 28/207

*Primary Examiner*—Robert R. Mackey

*Attorney, Agent, or Firm*—W. G. Fasse; D. H. Kane, Jr.

[57] ABSTRACT

In a device for individually separating heddles and to subsequently draw-in warp threads into the heddle eyes using advancing and retracting needles, the heddles require being moved into a precisely defined position of draw-in. Rest means with a serrated profile are provided, which receive the individually separated heddle by means of a pressing finger in such a manner that the heddle rests against one of the ramps of the sawtooth profile. The heddle is so rotated in the process that the aperture of the heddle eye is placed in a precisely defined position and furthermore practically transversely to the path of the draw-in needle. The drawing-in of the warp threads is thereby made substantially simpler and more reliable.

4 Claims, 5 Drawing Figures

FIG. 1
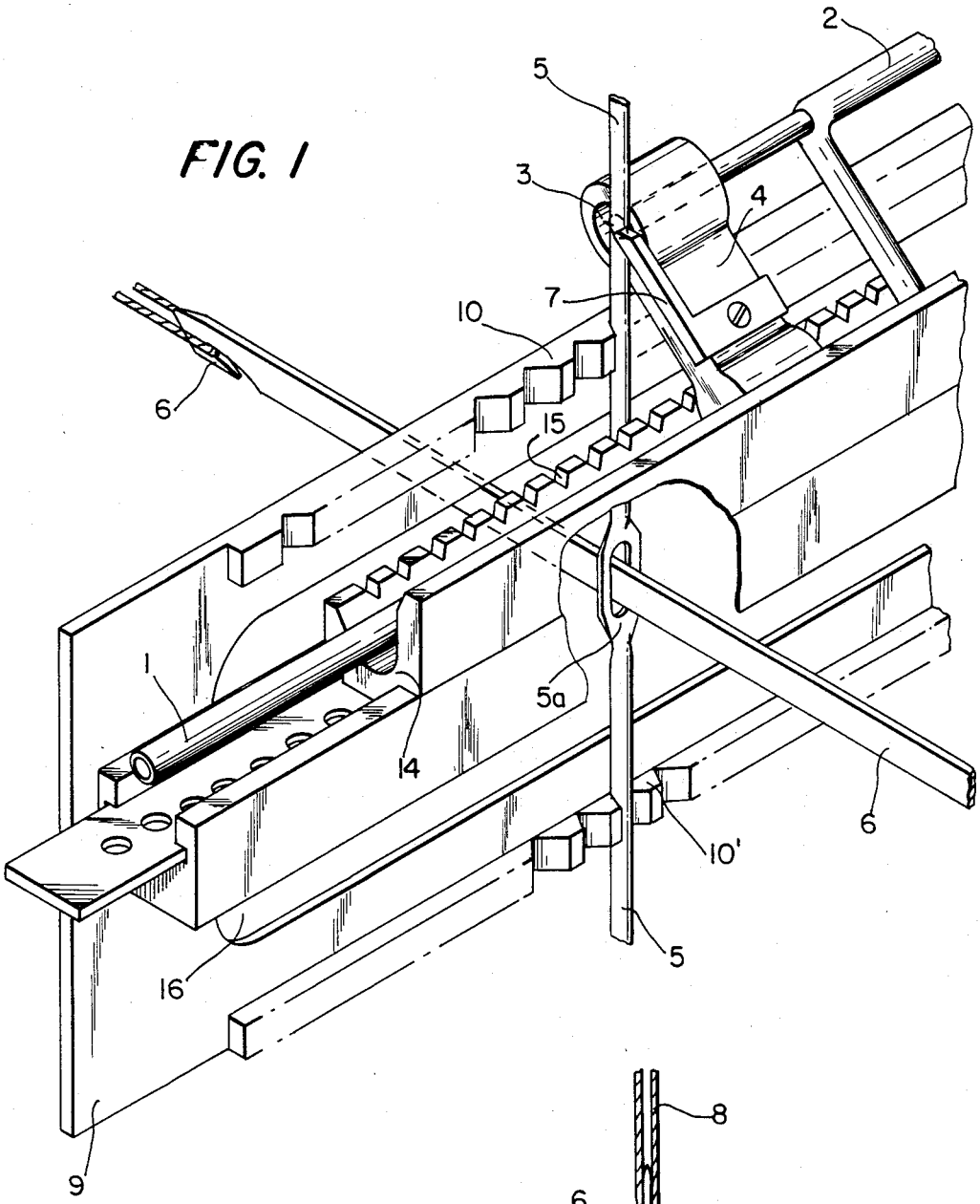
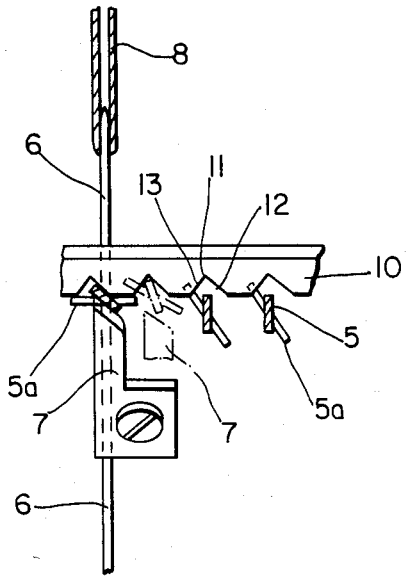
FIG. 2

DEVICE FOR INDIVIDUALLY SEPARATING AND ALIGNING HEDDLES FOR THREADING

FIELD OF THE INVENTION

The invention relates to a device for individually separating drop wires or heddles bunched into packs on heddle slide rails, where the particular foremost heddle of a pack can be lifted and moved by the intermediary of holding means on the slide carriage to a draw-in position of the warp thread, into the heddle eye. The holding means of the separation device are displaceable in the direction of advance of the heddles and can be pivoted from a rest position outside the plane of the pack into a operational position toward the plane of the pack, i.e., toward the plane of advance of the heddles.

DESCRIPTION OF THE PRIOR ART

Such devices are preferredly used to separate the heddles in warp thread draw-in apparatus of looms. The individual heddles separated and lifted from the pack are moved into such a location when in the draw-in position that the eye in the heddle is readied for the threading of the warp thread.

As a rule, a suction means is used to lift the heddle off of the pack and this means also may be reinforced by a weak magnet. The suction nozzles are arranged at the end of tubes bent in the manner of walking canes, extending parallel to the pack in the direction of advance of the heddles and which are displaceable to and fro in this direction in a restricted manner. Moreover, the tubes can be rotated about their longitudinal axes, whereby the bent-around ends with the suction nozzles can be pivoted from a rest position outside the plane of the pack into an operational position in the plane of the pack. The plane of the pack at the same time also is the plane of advance of the heddles wherein the heddles lifted by suction off of the pack are moved into the draw-in position of the warp threads. Such a device is described for instance in German Auslegeschrift No. 2,339,586, corresponding to U.S. Pat. No. 4,047,270, issued Sept. 13, 1977.

In practice, difficulties are encountered when the warp threads are drawn into the heddle eyes because the heddles are designed to be narrow, elongated elements and are arranged by their narrow side edges in the direction of the warp threads. The central part of the heddles ordinarily flares somewhat and contains an eye through which the warp thread will be drawn. The widened heddle segment with the heddle eye most often is somewhat twisted with respect to the remaining part of the heddle, whereby this segment points not by its narrow side edge, but rather by a widened oblique part, whence the aperture of the eye also is oblique and thereby readied for drawing-in the warp threads. A hook or a needle is pushed through the oblique aperture of the heddle eye for the draw-in procedure and with the assistance thereof the warp thread is also drawn-in. Despite the obliqueness of the heddle eye, difficulties are encountered when pushing the needle through, because the clear width for passing the needle through is slight and on that account hampers the insertion of the needle. This drawback is particularly noticeable when the heddles are not kept in well defined positions once in the draw-in location, and furthermore when warp threads for several heddles must be simultaneously drawn into correspondingly selected heddles.

OBJECT OF THE INVENTION

It is therefore the object of the present invention to eliminate these drawbacks and to make possible simple and reliable drawing-in of the warp threads into readied, individually separated heddles.

SUMMARY OF THE INVENTION

The invention starts from the initially described known devices to individually separate heddles, where the individual heddles lifted off of a pack are moved by holding means into the warp thread draw-in position. The solution provided by the present invention is that rest means with a sawtooth profile are provided in the area of the draw-in position of the heddles to the side of the plane of advance, and a projecting part is provided at the holding means to move the heddle into a gap of the sawtooth contour when the holding means is pivoted and to force the heddle flat against a ramp of the sawtooth contour together with rotation of the heddle when the same is further pivoted. A finger, for instance fastened to the holding means, can serve as such a pressing part, this finger being provided with a slant at its end to match the sawtooth ramp. During pivoting, the finger first forces the narrow side of the heddle laterally into the sawtooth gap. The moment the heddle lies by its narrow side in the deepest indent of the sawtooth, the heddle so rotates under the effect of the pressing finger that it will flatly hug a tooth ramp. The slanting of the finger ensures that the heddle always rotates in the proper direction and that, ultimately, it will lie flush against the tooth ramp. This rotation of the heddle in the sawtooth profile of the rest means takes place in a heddle area outside the central heddle eye area. Preferably, two individually separating devices are provided, namely one each above and below the heddle eye and correspondingly also two rest means arranged approximately symmetrically to the heddle eye. The individual heddle is kept immovably in its draw-in position by the pressing fingers. Due to the additional rotation, the heddle eye, which is slightly twisted already with respect to the remaining heddle parts, is rotated by another amount and the heddle eye therefore lies practically transversely to the draw-in position of the needle and the warp thread, offering the maximum inside width to the needle. In this manner the draw-in process is substantially facilitated.

BRIEF DESCRIPTION OF THE DRAWINGS

An illustrative embodiment of the invention is discussed below in relation to the drawings, in which:

FIG. 1 is a perspective of the device,

FIG. 2 shows a detail of the rest means as seen in a top view,

DETAILED DESCRIPTION OF PREFERRED EXAMPLE EMBODIMENTS AND OF THE BEST MODE OF THE INVENTION

Figure 3:
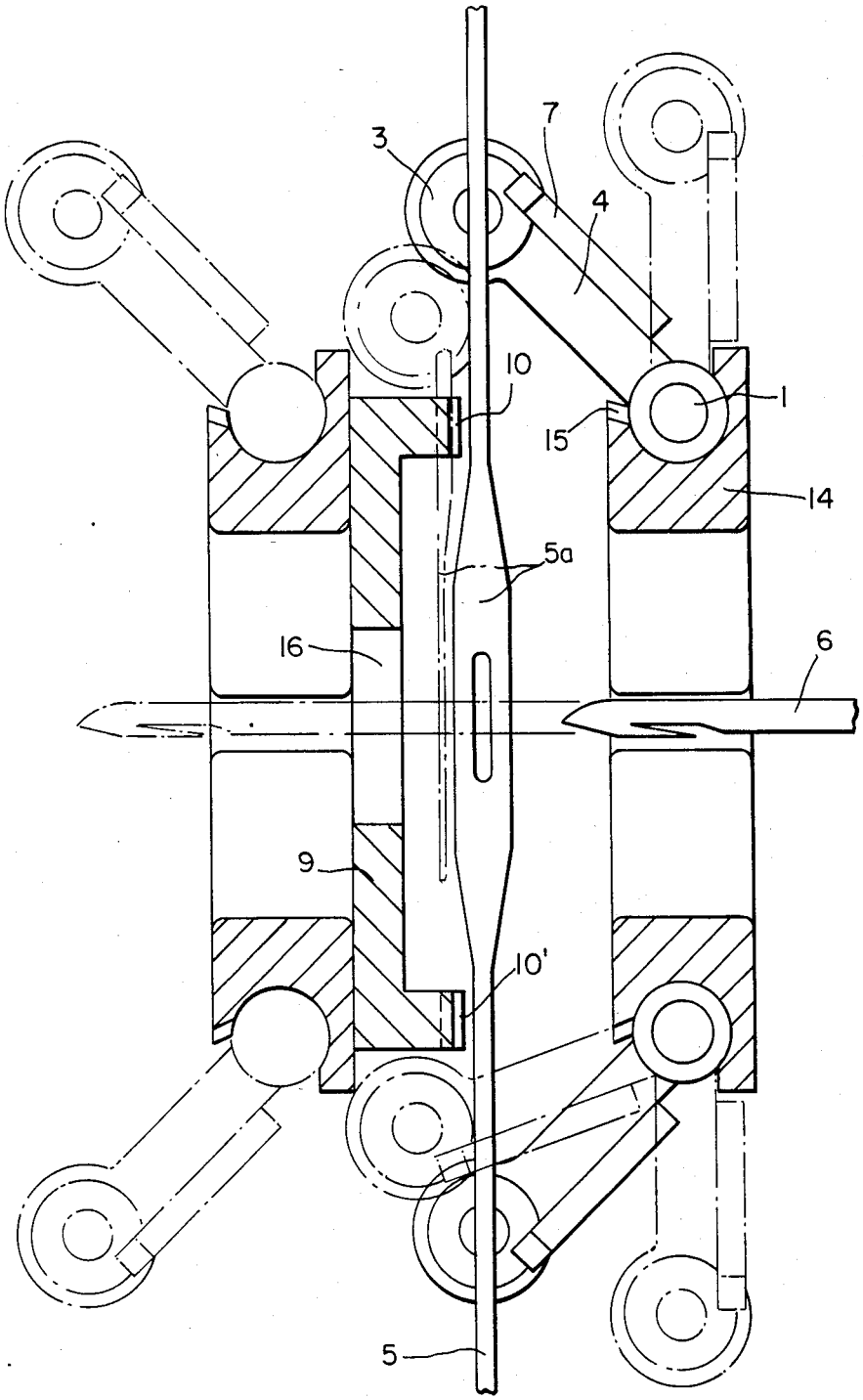
FIG. 3 is a simplified top view of the device shown in a partial section.

For the sake of clarity, several of the components shown in FIG. 3 are omitted from FIG. 1. It has been found in practice that it is appropriate to arrange the individual separating devices symmetrically with respect to the position of the heddle eye. Because of this symmetrical arrangement, only part of the components are denoted by reference numerals in the Figures, and furthermore the description will not specifically refer to the part of the device which is symmetrical thereto.

The construction of the device is described in relation to FIGS. 1 and 3. In this device, a known individual separator for heddles is provided. The device of the invention is composed of a tube 1 with an arm 4 mounted to its fore end and containing a suction nozzle to aspirate heddles off of a pack and further comprising a blow nozzle 2 by means of which after the warp thread has been drawn-in the heddle is moved on. A holding magnet 3 is further provided at the suction nozzle to reliably secure a lifted-off heddle 5. The operative mode of the individual separator is unrelated to the substance of the invention and may be presumed known herein. The tube 1 is longitudinally displaceable and rotatable about its axis. During the rotation, the attached arm 4 assumes together with the holding magnet 3 the various positions indicated in FIG. 3. The operational position is shown in solid lines in FIG. 3. The displacement of a heddle 5 lifted off of the pack into the draw-in position for the warp thread takes place in this position. After the heddle 5 has been threaded, the tube 1 is rotated until the arm 4 assumes the vertical position shown in dashed lines. For this position, the individual separator together with its suction and blow nozzles is withdrawn into the original position to lift off a new heddle. Guide elements 14 are provided to guide the advance and retraction motions of the separator which also permit pivoting the arm 4 between the end positions shown in dashed lines. The plane of motion or advance of the individually separated heddles 5 of FIG. 3 is formed by the plane along the heddle 5 and perpendicular to the plane of the drawing.

A plate 9 is mounted next and parallel to the plane of advance, with two rest means 10 and 10' being so mounted in this plate 9 that one of them is located above and the other below the flared heddle segment 5*a* containing the heddle eye. The drawing assumes that the two rests 10 and 10' are about symmetrical to the position of the flared part 5*a*. The two rests 10 and 10' have a sawtooth profile as shown in FIG. 1. As shown by FIG. 2, the sawtooth ramps are not the same, rather the ramp 12 is shallower than the associated ramp 13. It is assumed with respect to the ramp 12 that its slope subtends the same angle to the plane of advance as the one present between the perpendicular plane of the heddle and the twisted, flared middle-part 5*a* with the heddle eye opposite the plane. The plate 9 includes a sort of window 16, between the two rests 10 and 10' permitting passage of the needles or hooks 6 to grip the warp threads during the draw-in procedure. A loop of the gripped warp thread 8 is indicated at the end of the hook 6.

A finger 7 is laterally mounted to the above-mentioned pivoting arm 4 of the separator device, this finger 7 being located next to the heddle 5 during its advance and being without effect on the operation of the suction nozzle holding system or the holding magnet 3. This finger includes a slant at its end which is fitted to the shape of the shallower tooth ramp 12.

The device operates as follows: when a heddle 5 lifted off by the advance of the separator is moved in a preparatory manner into the draw-in position for the warp thread, the tube 1 with the arm 4 mounted thereon is pivoted from the operational position shown in solid lines in FIG. 3 into the extreme end position shown in dashed lines. In the process, the finger 7 comes into contact with the heddle 5 and inserts it into the associated serrate gap in the rest 10. This position is clearly shown in FIG. 1. In a corresponding manner the lower separator, which is symmetrically arranged and was discussed above, but which is omitted from FIG. 1, inserted the heddle 5 also into the serrate gap of the lower rest 10'.

The subsequent procedure is shown more clearly in FIG. 2. Starting at the right, various time-sequential positions of a heddle 5 are shown in several adjacent serrate gaps with tooth ramps 12 and 13. In reality, however, the process takes place sequentially in the same serrate gap. The twisted flared central part 5*a* with the heddle eye is clearly shown for the heddle 5 with the acute twist angle. First, the finger 7 presses the heddle 5 by its narrow edge against the serrate gap and thereby into the angle of the tooth bottom 11. As the arm 4 pivots further, the narrow edge of the heddle remains in the tooth bottom 11 while the remaining part of the heddle 5 moves laterally out of the way and accordingly, due to the slant of the finger 7, it will move toward the shallow tooth ramp 12. This position is shown in FIG. 2 in the third serrate gap from the right. As the arm 4 pivots further still together with the finger 7 fastened thereto, the heddle 5 at last is laid flat against the tooth ramp 12. This position is shown in the fourth serrate gap from the right. Due to this rotation of the heddle 5 however the center part 5*a*, already twisted with respect to the heddle 5, is rotated still further, whereby this middle part 5*a* containing the heddle eye assumes a practically transverse position with respect to the path of the draw-in needle 6, and hence the needle 6 can easily pass through the entire inside width of the heddle eye. Because of the symmetrical arrangement of the two rests 10 and 10' with respect to the central part 5*a* of the heddle 5 of FIG. 3 and because of the particular, associated fingers 7, the heddle 5 is held in place in a problem-free manner during the draw-in process above and below the heddle eye, that is, also above and below the window 16.

To assure there be the precisely proper draw-in position, the arrangement of the two rests 10 and 10' above and below the heddle eye suffices. A further improvement, however, is achieved when providing that the heddle 5 be inserted into the appropriate predetermined serrate gap in the rests 10 and 10'. This means that when displacing and then pivoting the arm 4 together with its finger 7, this finger 7 must be moved into its precise position so it is capable once there to properly grip the heddle 5 and insert it into the associated serrate gap. To that end, provision is made for comb-like projections 15 at the guide elements 14 on the edges opposite the rests 10 and 10', to engage corresponding clearances 17 in arm 4 when this arm 4 is being pivoted.

Figure 4A:
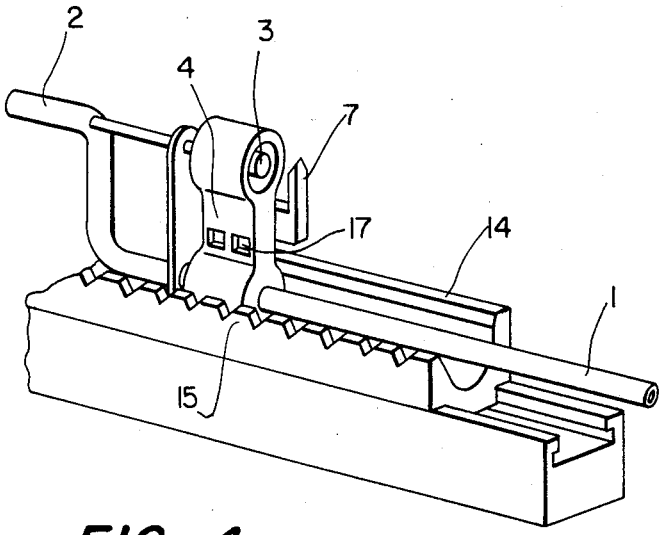
FIGS. 4*a* and 4*b* are details of the holding means and their guide elements in various pivot positions of the holding means.
Figure 4B:
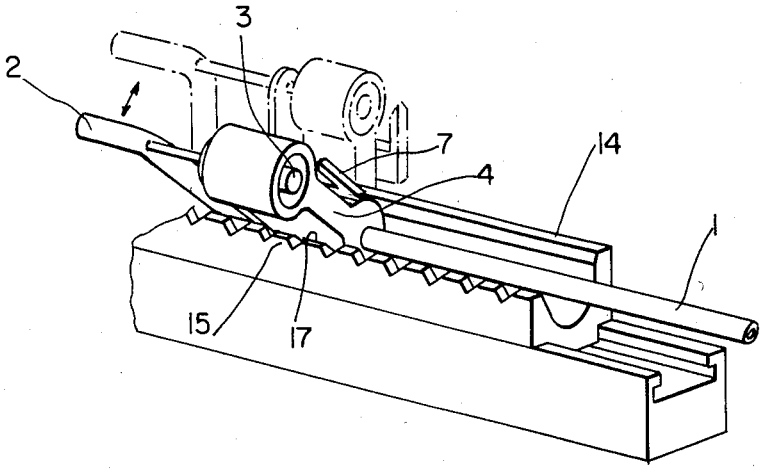

FIGS. 4*a* and 4*b* provide pertinent details. Viewed from the side of the rests, they show in cut-out form a guide element 14 with the tube 1 longitudinally displaceable therein and with the arm 4 mounted thereon, including its pressing finger 7. The comb-like projections 15 at the guide element 14 can be clearly seen, also the associated clearances 17 in the side of the arm 4. The projections do not engage the clearances when the arm 4 is in its rest position and in the simple pivoted operational position. Therefore the arm 4 can be displaced into this position together with the holding means 3 for the heddle to be moved in unhindered manner along the longitudinal direction of the tube 1 within the guide elements 14. The engagement of the projections 15 with the clearances 17 takes place only when the arm 4 is pivoted from the rest position shown in FIG. 4*a* beyond the operational position shown in FIG. 4*b* into the extreme end position (shown in dash-dot lines in FIG. 3), where the heddle 5 is laid into the serrate gap of the rest 10. The comb-like projections 15 are provided with ramps such that the edges of the clearances 17 can glide along when the pivoting into the extreme end position takes place. Advantageously such comb-like projections are trapezoidal or triangular and the clearances are correspondingly shaped in the side of the arm 4. When the device is pivoted into the extreme end position, the triangular tips of the combs engage the corresponding clearances in the arm 4, perforce entailing a correcting displacement of the arm 4 with its finger 7, whereby the heddle 5 and the finger 7 are always moved into the proper position to insert the heddle 5 into the desired serrate gap. The pitch of the sawtooth profile at the rests 10 and 10' and at the comb 15 corresponds to the pitch or repetition with which the individually separated warp threads are presented for heddle draw-in.

FIG. 3 shows another individually separating device to the left of the holding plate 9, being indicated by dash-dot lines, to convey the possibility of arranging several of the described devices in mutually parallel planes.

The number of devices corresponds to the number of the heddle frames present at draw-in. An upper and a lower individually separating device, each with one pressing finger 7 and one plate 9 with the rests 10 and 10' are required for each heddle frame with its pack of heddles. The number of teeth at the rests 10 and 10' corresponds to the number of available draw-in needles which may be simultaneously advanceable and retractable. The entire device is translated relative to the warp beam or to the heddles, for instance following the simultaneous drawing-in of twelve warp threads at twelve associated heddle frames from a total of, illustratively, twenty heddle frames. However, this procedure no longer is essential to the invention and accordingly is not described in further detail.

Although the invention has been described with reference to specific example embodiments, it will be appreciated, that it is intended to cover all modifications and equivalents within the scope of the appended claims.

What is claim is:

1. In a device for individually separating drop wires or heddles bunched into a pack on heddle slide rails of a heddle frame, where the particular foremost heddle of a pack is lifted from the pack by a separator associated with the pack and moved by holding means on the heddle slide rail into a position for drawing the warp thread into the heddle eye, and where the holding means of the individual separator is displaceable in the direction of advance of the heddles and can be pivoted from a rest position outside the plane of the pack into an operational position toward the plane of the pack and toward the plane of advance of the heddles, the improvement comprising rest means (10, 10') mounted in the draw-in area of the heddles (5) laterally next to the plane of advance, said rest means (10, 10') being equipped with a serrated profile, and a projecting part (7), mounted on holding means (3, 4), which upon pivoting of said holding means (3, 4) displaces the heddle (5) into a gap of the serrated profile and upon further pivoting presses the heddle (5) with rotation flatly against a ramp (12) of the sawtooth profile, whereby the heddle eye assumes a substantially transverse position with respect to the path of threading of a warp thread therein.

2. The device according to claim 1, in which said projecting part comprises a finger (7) with a slant fitted to said sawtooth ramp (12) positioned at the holding means (3, 4).

3. The device according to claim 1, in which the sawtooth profil ramp (12) acting as the rest (10) for the heddle (5) extends approximately at an angle to the plane of advance which corresponds to the twist between the heddle (5) and the heddle eye (5*a*).

4. The device according to claim 1, in which the individual separator moves at least within the area of the draw-in position in longitudinal guide means (14) and the edges of the longitudinal guide means (14) opposite the rest means (10, 10') are provided with comb-like projections with a pitch corresponding to the sawtooth profile, and including clearances (17) at the pivoting holding means (3, 4) corresponding to the projections (15) and engaging them during pivoting motion of the holding means (3, 4).

* * * * *